US008314322B2

(12) United States Patent
Langberg

(10) Patent No.: US 8,314,322 B2
(45) Date of Patent: Nov. 20, 2012

(54) SYSTEM AND METHOD FOR REMOTELY GENERATING SOUND FROM A MUSICAL INSTRUMENT

(76) Inventor: Eric Aaron Langberg, Milford, PA (US)

( * ) Notice: Subject to any disclaimer, the term of this patent is extended or adjusted under 35 U.S.C. 154(b) by 581 days.

(21) Appl. No.: 11/619,212

(22) Filed: Jan. 3, 2007

(65) Prior Publication Data

US 2008/0156167 A1 Jul. 3, 2008

(51) Int. Cl.
*G10H 3/00* (2006.01)

(52) U.S. Cl. ..... 84/723

(58) Field of Classification Search ..... 84/723, 84/725, 726, 730, 731, 735, DIG. 21, DIG. 24
See application file for complete search history.

(56) References Cited

U.S. PATENT DOCUMENTS 3,443,468 A * 5/1969 Kidwell ..... 84/315
3,612,741 A * 10/1971 Marshall ..... 84/723
3,725,561 A * 4/1973 Paul ..... 84/726
3,826,171 A * 7/1974 Kaar ..... 84/297 S
3,882,754 A * 5/1975 Godley et al. ..... 84/320
4,037,503 A * 7/1977 Jacobson et al. ..... 84/9
4,075,921 A * 2/1978 Heet ..... 84/738
5,031,501 A * 7/1991 Ashworth ..... 84/723
5,083,491 A * 1/1992 Fields ..... 84/21
5,142,961 A * 9/1992 Paroutaud ..... 84/726
5,315,060 A * 5/1994 Paroutaud ..... 84/726
5,393,925 A * 2/1995 Wilson ..... 84/9
6,166,307 A * 12/2000 Caulkins et al. ..... 84/50
6,191,350 B1 * 2/2001 Okulov et al. ..... 84/646
6,610,917 B2 * 8/2003 Ludwig ..... 84/726
6,700,047 B2 * 3/2004 Carter, Jr. ..... 84/603
6,723,904 B1 * 4/2004 Dolan et al. ..... 84/267
6,846,980 B2 * 1/2005 Okulov ..... 84/646
7,087,828 B2 8/2006 Krieger
7,285,709 B2 * 10/2007 White et al. ..... 84/321
7,285,716 B2 * 10/2007 Gilmore et al. ..... 84/739
7,291,780 B2 * 11/2007 Hosler ..... 84/725
7,432,428 B2 * 10/2008 Kunisada et al. ..... 84/13
7,453,040 B2 * 11/2008 Gillette ..... 84/723
7,514,614 B2 * 4/2009 McGrew ..... 84/291
7,678,987 B2 * 3/2010 Lye ..... 84/723
7,687,697 B2 * 3/2010 Ognibeni ..... 84/291
7,786,374 B2 * 8/2010 Valli et al. ..... 84/737
7,968,788 B2 * 6/2011 Shinjo et al. ..... 84/743

* cited by examiner

*Primary Examiner* — Elvin G Enad
*Assistant Examiner* — Andrew R Millikin

(57) ABSTRACT

A system and method for remotely generating sound from a musical instrument. In one embodiment, the system includes an input configured to receive a signal representative of the sound of a first musical instrument, an exciter for converting the signal to mechanical vibrations, and a coupling interface for coupling the mechanical vibrations into a second musical instrument. The method for remotely generating sound includes the steps of generating a signal representative of the sound of a first musical instrument, transmitting the signal, receiving the signal at an input, converting the signal to mechanical vibrations, and coupling the mechanical vibrations to a second musical instrument capable of producing sound waves.

29 Claims, 7 Drawing Sheets

SYSTEM AND METHOD FOR REMOTELY GENERATING SOUND FROM A MUSICAL INSTRUMENT

FIELD OF THE INVENTION

The present invention relates to the field of music creation and musical instruments. More particularly the invention relates to generating sounds from a musical instrument without direct contact between a musician and the musical instrument.

BACKGROUND OF THE INVENTION

Typical musical instruments are designed to be played by a musician through direct physical contact of the musician with some part of the instrument. Attempts to create instruments that do not require direct contact of the musician have generally been approached from either a) mechanical actuators, or robotics, replacing the hands and/or feet of a musician and attempting to replicate the motions of the musician or b) electronics instruments which may be played by control signals from either a computing device or a control surface, such as a keyboard, played by a musician. In the first case, the musical instruments are commonly acoustic instruments and the robotics, which are activated by control signals or mechanical controls, act as the musician, producing sound from the instrument in the same manner as if a human musician were playing the instrument. In the second case, the sound is created electronically and must be converted to an audible sound using an amplifier and loudspeaker.

Some musical instruments are available in two forms: acoustic instruments and electric instruments. Acoustic instruments can be played and heard by an audience without the need for amplification or loudspeaker. An example would be an acoustic piano, which can be heard in a room without any form of electronic amplification. Electric instruments generally require some form of electronic amplification and loudspeaker to be heard by an audience and have an output jack which sends an electrical signal to amplifiers, processing electronics or recording devices. An example would be an electric piano or synthesizer which would require an electronic amplifier and loudspeaker to be heard. Musicians choose acoustic or electric instruments based on the desired sound and application and often will switch back and forth between them based on the song being performed to employ the different sounds.

An acoustic instrument creates an audible sound by the creation of vibrations within the instrument which are generated by the actions of the musician. The vibrations excited within the instrument by the musician are affected by the physical form of the instrument, which serves to excite corresponding vibrations in the air surrounding the instrument. The vibrations of the air around the instrument are carried as sound waves through the air to the ear of the listener. An acoustic instrument generally has a different sound characteristic than its electric counterpart, mainly due to the construction of the body of the instrument, which has a significant impact on the overall sound. Body characteristics, materials, and construction methods that make for a good acoustic instrument are generally quite different than those that make for a good electric instrument.

An electric instrument generates an electrical signal in response to the actions of a musician. This signal is sent to an electronic amplifier, which drives a loudspeaker to create sound waves which can travel through the air to the ear of the listener.

Many instruments are available in either acoustic or electric form and some are available in a combined form. One such combined form is the inclusion of an electric sensor or microphone in an acoustic instrument, such as an acoustic guitar, so the instrument may be used as an acoustic instrument or the electrical output may be plugged into other electronics, such as an electronic amplifier. Attempts to provide an acoustic sound from an electric instrument have been attempted by inclusion of a mechanical sensor in an electric instrument to pick up the mechanical vibrations in the instrument and convert them to an electrical output signal. The acoustic properties of the electric instrument are vastly different from those of the acoustic instrument, so these combined form instruments frequently result in a reduction in the sound quality of either the electric sound, the acoustic sound, or both.

One problem encountered by musicians is the inability to easily switch back and forth between the acoustic instrument sound and the electric instrument sound in the same performance. In the case of an instrument that is held in the hands as it is played such as guitar, violin, saxophone, etc., the musician must put down or let go of one instrument, for example an acoustic guitar, before playing another, for example an electric guitar. This can interfere with a performance because the musician must stop playing for a period of time while changing instruments. The combined form of an electric and acoustic instrument mentioned earlier is an attempt to improve this situation, but as mentioned previously the body of the instrument greatly affects the sound and the combined form usually results in inferior sound from either the acoustic instrument sound or the electric instrument sound from these combined instruments.

Another problem faced by musicians is that generally only one instrument may be played at a time. If a musician had the capability of having one performance generate sound from multiple instruments, the overall sound could be much fuller and richer. Electronic synthesizers often have the capability of generating multiple sounds from a single performance, but other traditional instruments do not.

Another problem encountered with the existing state of musical instruments is that there is no way to exactly repeat a performance using a different instrument. If a musician plays and records a piece of music perfectly on an electric guitar, for example, and then later decides it would sound better on an acoustic guitar, the entire performance must be repeated and recorded using the acoustic guitar, which can take significant time due to the chance for mistakes.

Yet another shortcoming of the existing art in musical instruments is that all instruments must be available to the musician at the time of the performance. There is a standard called Musical Instrument Digital Interchange (MIDI) which provides for the recording of certain performance information which can then be used to trigger sounds from a synthesizer at a later time, but the standard does not include provisions, method or any mechanism for generating sounds from a real instrument.

What is needed is a way to enable the playing of a musical instrument without the musician having to physically touch it so the musician may "play" multiple instruments at the same, switch back and forth between different instruments without having to stop playing, use a previously recorded signal to play a musical instrument, or play an instrument in a remote location.

SUMMARY OF THE INVENTION

Disclosed is a system and method for remotely generating sound from a musical instrument. In one embodiment, the system includes an input configured to receive a signal representative of the sound of a first musical instrument, an exciter for converting the signal to mechanical vibrations, and a coupling interface for coupling the mechanical vibrations into a second musical instrument.

An object of the disclosed system is to provide a device for remotely generating sound from a musical instrument.

Yet another object of the disclosed system is to provide a device which can accept an input signal, convert the input signal into vibrations, and couple the vibrations into a musical instrument, producing a sound different from that of the original input signal.

An object of the disclosed method is to provide a method for playing a musical instrument without physically touching it. Disclosed is a method which allows generation of sound in a musical instrument from a remote signal, without requiring physical contact between a musician and the instrument.

DETAILED DESCRIPTION OF THE PREFERRED EMBODIMENTS

Figure 1:
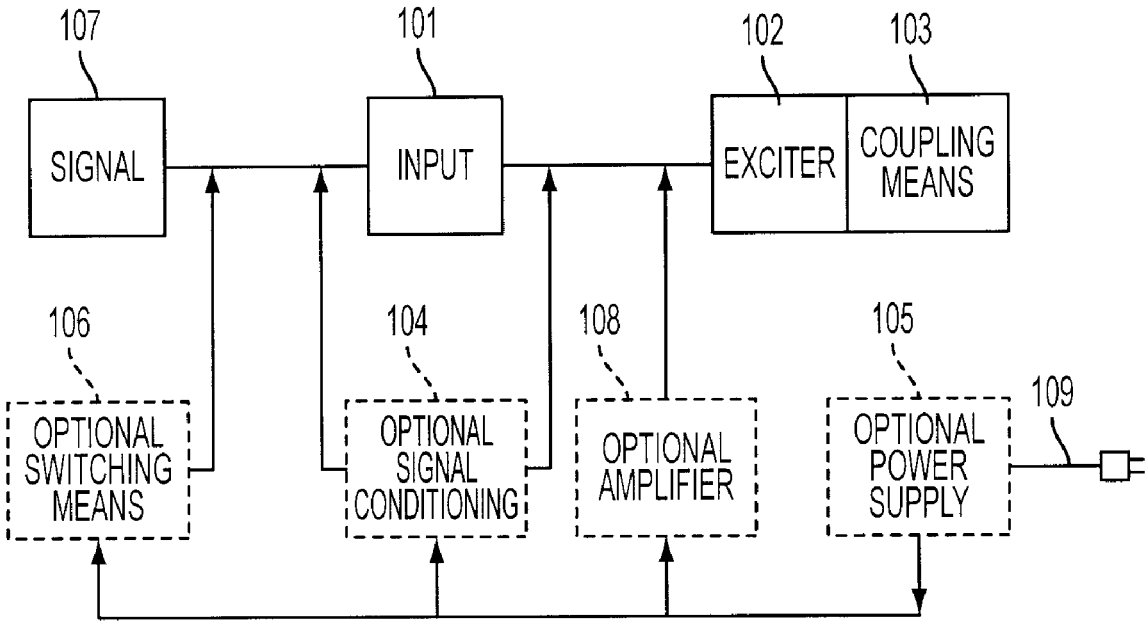
FIG. 1 is a Block Diagram of Disclosed system

The disclosed system comprises a system and method for using a signal to excite vibrations in a musical instrument without a musician having to physically touch the instrument. By exciting vibrations at the correct location(s) in the instrument, the overall sound characteristic of the instrument is maintained even though a musician is not playing the instrument in the traditional manner.

In one embodiment, the disclosed system provides an input for receiving an externally generated signal, an exciter for creating vibrations, and a coupling interface for coupling the vibrations into a musical instrument.

The disclosed system provides a significant improvement in the amount of flexibility afforded the musician during performance by allowing the musician to get sound from a second instrument while playing a first instrument, without having to stop playing the first instrument.

Another benefit of the disclosed system is that it allows an instrument to be played which is remotely located. A signal may be transmitted using any available transmission method to another location where the disclosed system is installed and the instrument on which the disclosed system is installed may be played by the remote signal. This would allow for totally new ways of transmitting and receiving live performances. Instruments may be distributed in many different locations, including private homes, with the disclosed system installed. A musician can play a single instrument which would be used to generate the signal to be transmitted to all the distributed disclosed systems. Each instrument to which the disclosed system was installed would, upon receiving the signal, sound as if the musician were in the room playing that particular instrument.

The disclosed system may also be used to allow an instrument to be played at a different time than the original performance. A recording of a performance may be used as the signal sent to the disclosed system. The recorded signal would "play" the instrument without a musician even being present at the time of playback. This provides a way to play an instrument that is not available to the musician at the time of the original recording or the ability to go back to a recording and change the sound of an instrument by having the recorded signal play a different musical instrument than the one originally recorded.

The disclosed system allows an instrument to be played via a signal generated by another instrument or computer to get a totally different sound that combines the sound characteristic from the original instrument with the sound characteristic of the instrument to which the disclosed system is installed.

The disclosed system in one embodiment may further be used to create instruments from objects not normally viewed as musical instruments, such as, but not limited to a chimnea, a pipe, a bottle, a bowl, a box, etc. These objects would produce sounds unlike other musical instruments which exist today, and there is nothing available today to play objects not designed to be musical instruments using a signal from a musical instrument.

In the following description of one embodiment, reference is made to the included drawings which form a part of this specification and are included to illustrate specific embodiments of how the disclosed system may be practiced. It should be understood by the reader that structural changes may be made without departing from the scope of the disclosed system. It should also be understood that the embodiment(s) illustrated is not intended to limit the scope of the disclosed system and the inventor anticipates changes in the structure and form of the disclosed system to properly adapt to the physical form of different musical instruments.

FIG. 1 is a block diagram of the disclosed system and its operation. The disclosed system is a system which comprises an input 101, at least one exciter 102, and a coupling interface 103 and is designed for the purpose of creating vibrations in a musical instrument, making the instrument radiate sounds as if it were being played by a musician directly.

A signal 107 is generated, by a first musical instrument, by a recording of a first musical instrument, or by other method, which represents the sound of a first musical instrument.

The system is installed on a physical object, such as a second musical instrument.

The signal 107 is fed to the input 101 of the system, optionally passing through a switching system 106 and/or a signal conditioning element 104.

The input 101 receives the signal 107, which may be transmitted from the source in a variety of ways including, but not limited to, a wire, optically, RF waves or other wireless transmission methods. Signal transmission systems and methods are well known in the art for carrying electrical, optical, acoustic, and radio frequency signals. The input 101 may comprise a jack, a plug, a hard-wired connection, a wireless connection, or other device for receiving the signal 107. If required, the input 101 converts the received signal to an electrical signal.

The exciter 102 accepts the electrical signal from the input 101 and converts it to mechanical vibrations. Transducers to convert electrical signals to mechanical vibrations are well known in the art and many of the different types may be employed in the practice of the disclosed system including, but not limited to, solenoids, linear actuators, piezoelectric transducers, and electromagnetic actuators. An electromagnetic transducer based on a fixed permanent magnet and a moving coil of wire mounted to a former is well known in the art and may be employed as the exciter in the practice of the disclosed system. The range of human hearing is normally taken to be 20 Hertz to 20,000 Hertz but musical instruments often have a frequency range significantly less than the full range of human hearing. Optimally, the exciter 102 would be capable of exciting all frequencies of vibration that the acoustic instrument could normally reproduce. However, the exciter 102 may be effectively employed to reproduce a subset of those frequencies where the frequencies of vibration would not normally be heard, the input signal 107 is of limited bandwidth, or certain frequencies are not desired for a particular sound or special effect.

The coupling interface 103 provides a way to transfer the vibrations from the exciter 102 to the target instrument. Optimally, the coupling interface 103 would include mounting provisions for keeping the disclosed system in contact with the target instrument for effective transmission of the mechanical vibrations from the exciter 102 to the instrument. The vibrations may be coupled through direct contact of some portion of the exciter 102 to some portion of the instrument, or they may be coupled through an additional element or elements. In one embodiment, the mechanical actuator is integrated directly into the structure of the musical instrument to directly couple the vibrations into the structure of the instrument. In this embodiment, the coupling interface 103 would be the direct contact of at least some portion of the exciter 102 to some portion of the instrument structure. In other embodiments, the coupling interface 103 may take the form of a mounting bracket, adapter, clamp, adhesive, or other forms or materials which direct the vibrations formed by the exciter 102 into the instrument. The coupling interface 103, as well as mounting provisions, may be integrated into the housing of the exciter and still be within the scope of the disclosed system. The only requirement for the coupling interface 103 is that there be a manner in which the vibrations from the exciter can be transferred to the target instrument. In one embodiment, the coupling interface 103 would take the form of an adapter configured to mount the exciter in the optimum location on a target instrument, however, the coupling interface 103 need not embody a separate physical component.

An optional signal conditioning element 104 may be placed anywhere in the signal path to modify the signal 107 prior to the signal getting to the exciter 102. The signal conditioning element 104 may comprise one or more active or passive electrical circuits. This may be done to emphasize or de-emphasize certain frequencies to achieve a better overall sound. It may also be done to change the amplitude of the signal 107, add special affects, or provide other signal transformations as are well known in the art of music electronics. Signal conditioning of musical instrument signals is well known in the art and includes many effects such as chorus, reverberation, time delay, phase shifting, amplitude modulation, frequency modulation, distortion, overdrive, spectral modifications, equalization and others.

The disclosed system may be practiced in such a manner that no power other than the input signal 107 is required if the input signal 107 can be ensured to be large enough to drive the exciter 102 directly. In cases where this is impractical, for example when the input signal 107 is transmitted to the input 101 via a wireless connection, a power supply 105 and signal amplifier 108 would be added to the system to generate a strong enough signal to drive the exciter. The power supply 105 may get power from an AC power cord 109 or via a battery (not shown) or other power storage device (not shown). Power supplies and amplifiers are well known in the art.

The disclosed system may be further extended in usability by inclusion of an optional switching system 106 which provides for easily directing the signal 107 from a musician's instrument to either the disclosed system input 101 or to another device's input. As an example, if the musician is playing an electric guitar and the disclosed system is mounted on an acoustic guitar, the optional switching system 106 would allow the musician to have the output from his electric guitar routed to an amplifier to reproduce the electric guitar sound, or to the disclosed system to play the acoustic guitar sound.

The system may be, but need not be, housed in a single housing. Partitioning the system into multiple assemblies can provide flexibility in application and allow for size reductions of the individual components. In some applications it may be preferable to have the exciter and coupling interface integrated into an adapter configured for easy mounting to the target instrument, with any electronics located in another housing away from the exciter and coupling interface. This would reduce the weight, size, and complexity of the exciter and coupling interface assembly. In one embodiment, the input, all electronics and a switching system would be housed in a first housing, while the exciter and coupling interface would be included in an assembly configured to mount to a target musical instrument.

Figure 2:
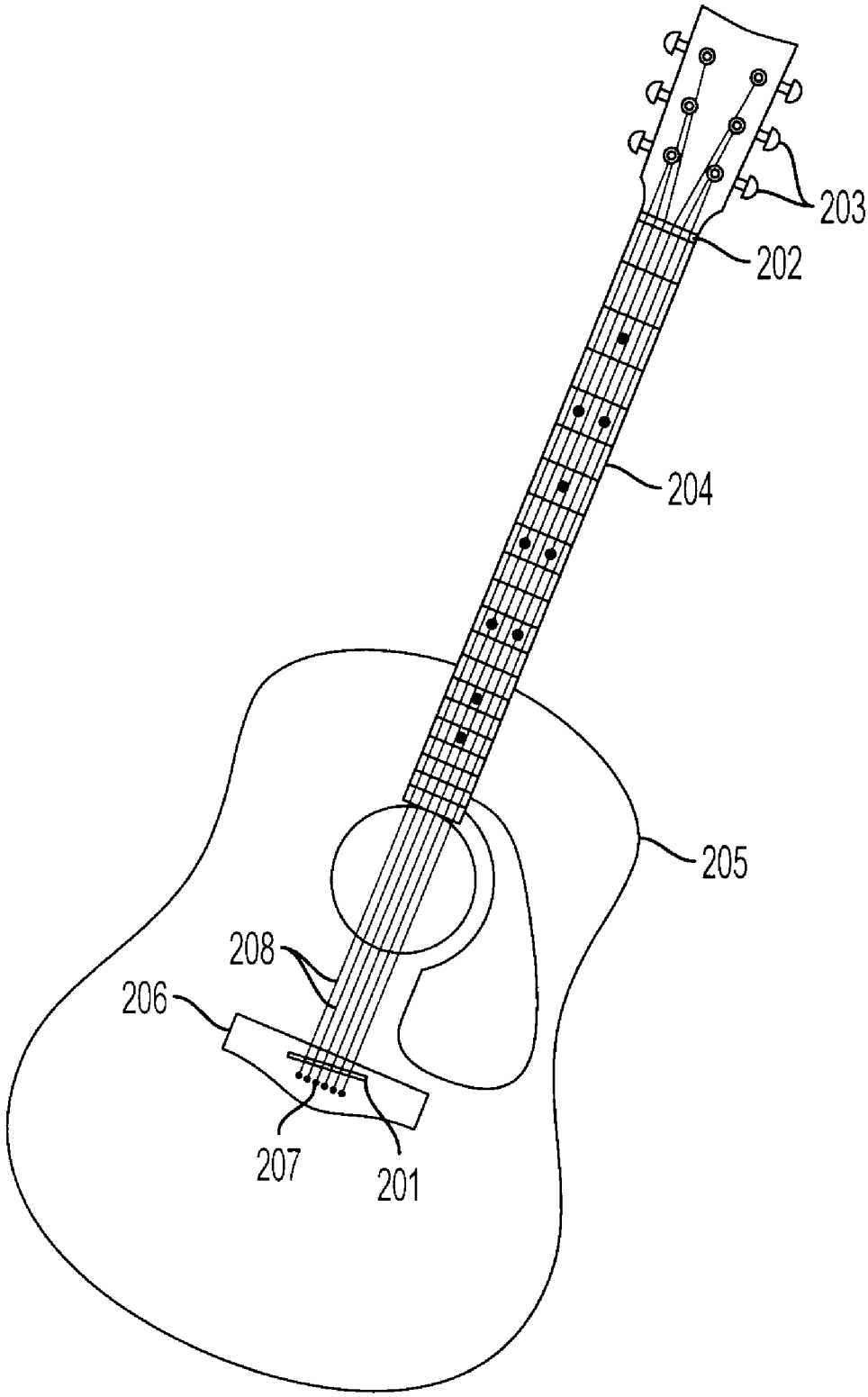
FIG. 2 depicts an Acoustic Guitar for reference.

An embodiment adapted for use on an acoustic guitar will be now described to illustrate one embodiment. A common acoustic guitar FIG. 2 consists of strings 208 fixed at one end by end pins 207, routed over a support device called the "saddle" 201, which is mounted to the bridge 206, to another support device called the "nut" 202 and to tuning mechanisms 203 which allow the tension of the strings 208 to be adjusted. The strings 208 are set into motion by the actions of the musician who generally strums or picks the strings. The vibration of strings at different tensions creates the different notes heard from the guitar. The musician may change the tension and length of the vibrating string by pressing the string to the neck 204 of the guitar at different points to create different notes. The bridge 206 is attached to the top of the body 205 of the instrument and with the saddle 201 forms the main point of contact for the vibrations of the strings 208 to be coupled to the body 205 of the instrument. The sound of the guitar is primarily a result of the coupling of the vibrations of the strings 208 at the bridge 206 to the body 205 of the guitar and the resulting vibration of air in and around the body 205 of the guitar. Vibrations at the nut 202 or along the neck 204 do not couple significantly in the overall sound output. When the disclosed system is used with a guitar, the optimum point of coupling is at the saddle 201. An adapter is designed to allow the disclosed system to be positioned in such a manner that it is in contact with the saddle 201 or on the bridge 206 in the region closely surrounding the saddle 201. When a signal 107 is applied to the disclosed system, the disclosed system vibrates the saddle 201 and bridge 206, which in turn vibrates the body 205 of the guitar in a manner nearly the same as the action of the vibrating strings 208, resulting in a sound which is nearly the same as that which would be created by the vibrating strings 208. Coupling the disclosed system to other points on the guitar will create a different sound than the one created when the disclosed system is attached near or at the bridge 206, but in some cases this different sound may be found to be desirable. Additionally, since the sound of the guitar is primarily a result of vibrations coupling into the bridge 206 through the saddle 201 and since the nut 202 and neck 204 do not contribute significantly to the overall sound output, the disclosed system may be used even with no strings 208 installed. In fact, it is not even necessary to have a neck 204 installed on the acoustic guitar body 205 for the disclosed system to function properly.

Figure 3:
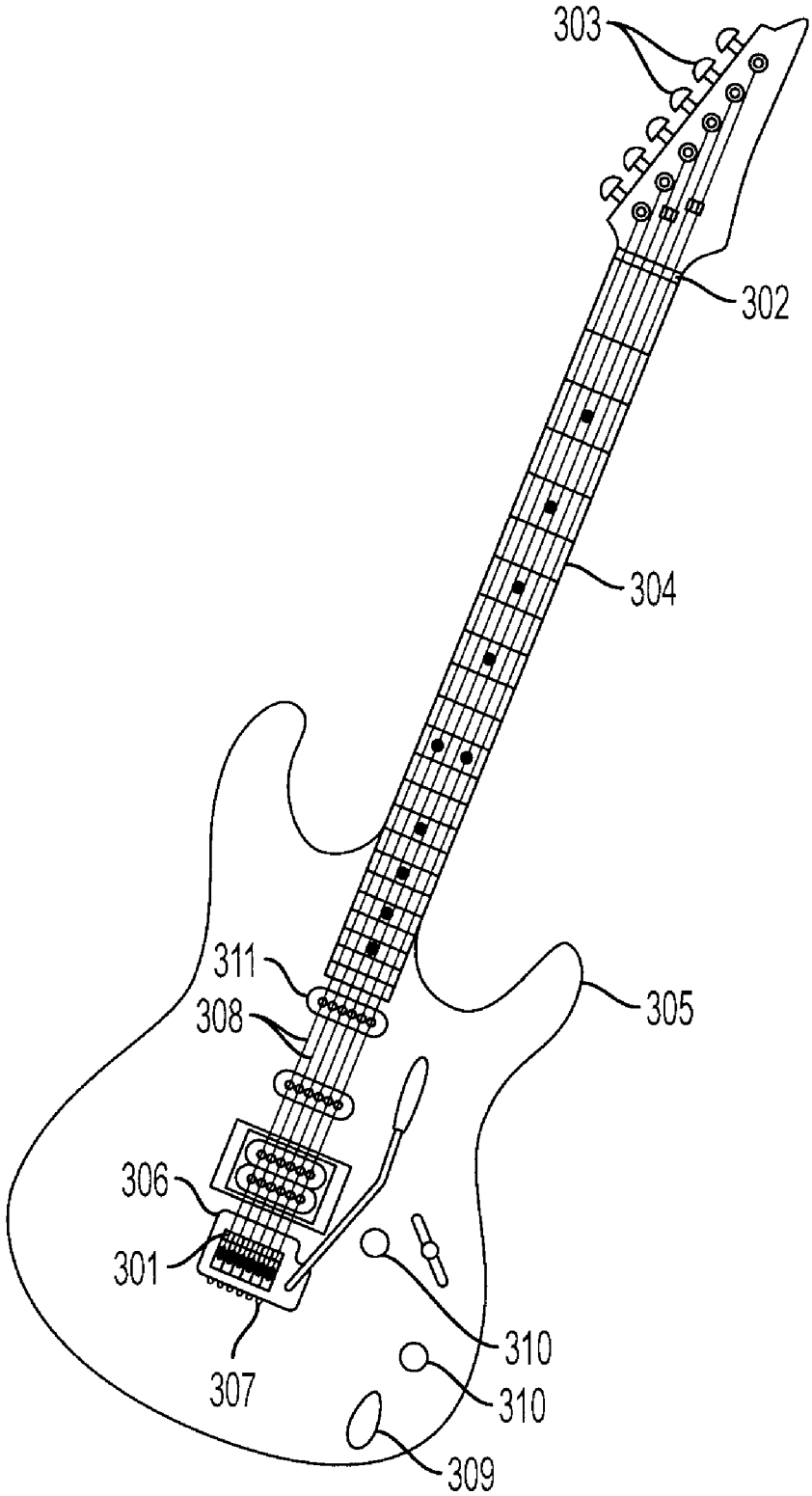
FIG. 3 depicts an Electric Guitar for reference.

FIG. 3 illustrates a common electric guitar. Many of the features of the electric guitar are similar to those of the acoustic guitar, with the inclusion of a body 305, a neck 304, a nut 302, tuning mechanisms 303, and strings 308. The bridge 306, however is of a different construction and is usually made from metal, rather than the wood used on the bridge of the common acoustic guitar shown in FIG. 2. The bridge 306 on the electric guitar commonly uses multiple saddles 301, rather than the single saddle 201 found on the acoustic guitar in FIG. 2. The electric guitar does not use end pins 207 to secure the strings, they are commonly either passed through holes 307 in the bridge 306 or clamped to the bridge 306 with a clamping mechanism (not shown). The electric guitar has some elements not found on the acoustic guitar such as the pickups 311, which sense the motion of the vibrating strings 308, generally using a magnetic field, and generate a corresponding electrical signal. The electrical signal is routed to output jack 309 for connection to electronic amplifiers. Controls 310 typically provide for level control of the electrical signal and sometimes also provide for modification of the frequency response of the signal.

Figure 4:
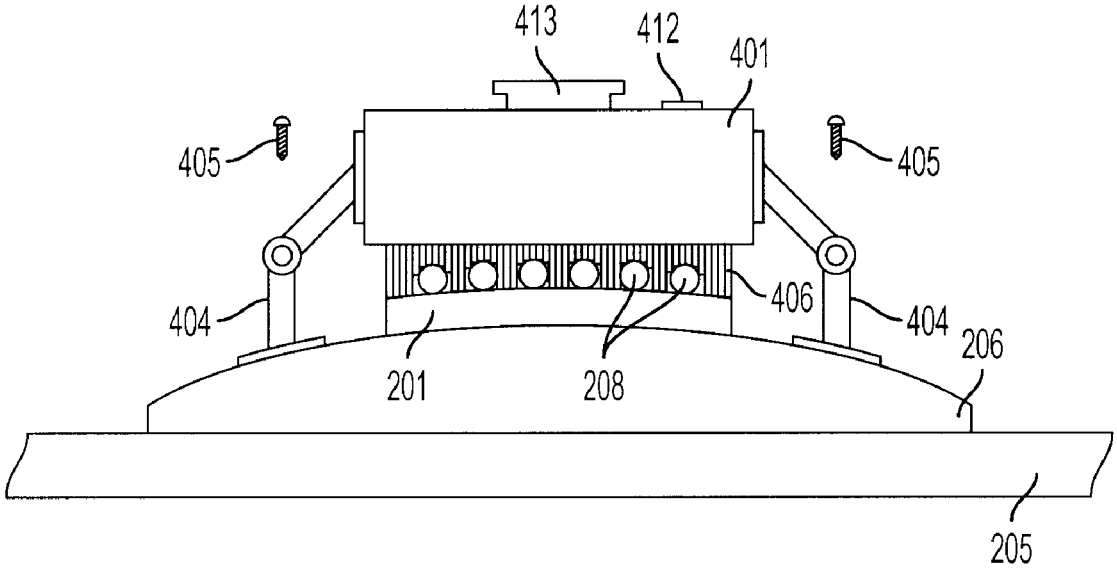
FIG. 4 illustrates an embodiment of the disclosed system for use with an acoustic guitar.

FIG. 4 shows a close-up view of one embodiment of the disclosed system permanently mounted to the bridge of an acoustic guitar. A mounting adapter assembly 401 is provided with mounting arms 404, through which screws 405 may be installed to secure the assembly to the bridge 206. Saddle 201 is often curved from end to end, so the adapter includes sliding bars 406, which can contact the top of saddle 201 at multiple points along its radius in between the strings 208. Once the sliding posts 406 are adjusted along the radius of the saddle 201, they are locked in place by a locking mechanism on the rear of the assembly (not shown). Exciter 413 and input 412 are secured to the mounting adapter 401. Input 412 is electrically connected to the exciter 413. When a signal 107 is applied to the input 412, the signal causes exciter 413 to create mechanical vibrations in the mounting adapter assembly 401, which serves as the coupling interface to couple the vibrations from the exciter 413 to the saddle 201, into the bridge 206, and into the body 205. The vibrations in the body 205 cause vibrations of the air in and around body 205, creating audible acoustic waves.

Figure 5:
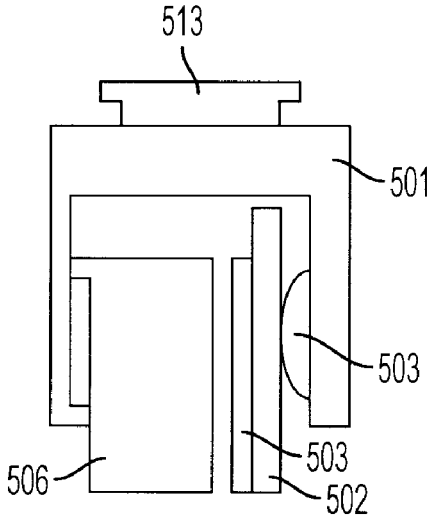
FIG. 5 illustrates an embodiment of the system with an adapter for use with an acoustic guitar

FIG. 5 provides a cutaway side view of the assembly in FIG. 4. Mounting adapter housing 501 houses a linear array of sliding bars 506 which are adjusted to the correct position on the saddle or bridge of the target instrument. Locking plate 502 is pushed forward by a locking mechanism 503, compressing a compressible material 503 against the sliding bars and preventing any motion of the bars. The compressible material may be rubber, silicone, or other elastomer which may be compressed between locking bar 502 and the sliding bars 506 while providing enough friction to prevent the bars from moving once engaged. Vibrations from exciter 513 are imparted to housing 501 and into sliding bars 506.

Figure 6A:
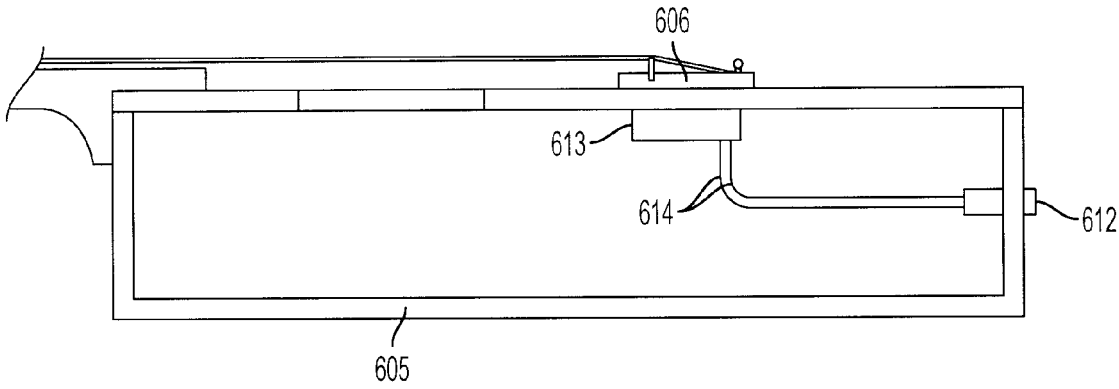
FIGS. 6A and 6B are cutaway views showing how the disclosed system may be integrated into an acoustic guitar.
Figure 6B:
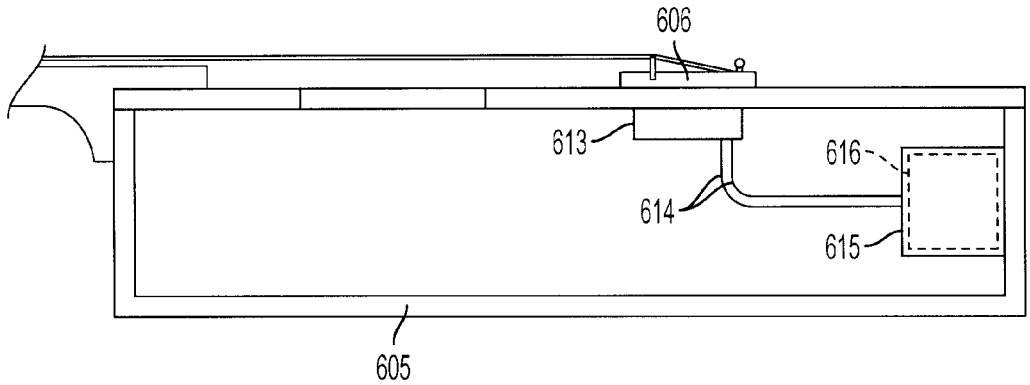

While FIG. 4 shows a permanent attachment, the disclosed system may be permanently attached, removably attached, or even integrated into the structure of the acoustic instrument as indicated in FIG. 6A and FIG. 6B. It may be attached to an internal member of the instrument or an external member of the instrument. In FIG. 6A, exciter 613 is mounted directly to the underside of bridge 606. Input jack 612 is mounted to the body 605 and connected by wires 614 to the exciter 613. Different mechanical adapters may be employed to facilitate different mounting methods or to provide improved attachment to different instruments. FIG. 6B shows a similar setup, but with the input jack replaced by a wireless receiver 615, which would be powered by a battery (not shown) to allow wireless reception of an external signal. Electronics for amplification, power supply, any signal conditioning, and the wireless receiver could be contained on one or more circuit assemblies. A printed circuit board 616 is shown in FIG. 6B to be integrated into the wireless receiver 615.

The external signal 107 sent to the disclosed system could be generated by any type of source, but most commonly would include an electric version of same type of instrument, electric version of similar type of instrument (ie one string instrument to another or one reed instrument to another), recording of a musical instrument, electrically generated source (such as computer generated signal), or an electric signal from instrument of completely different type (ie saxophone played through acoustic guitar).

Figure 7:
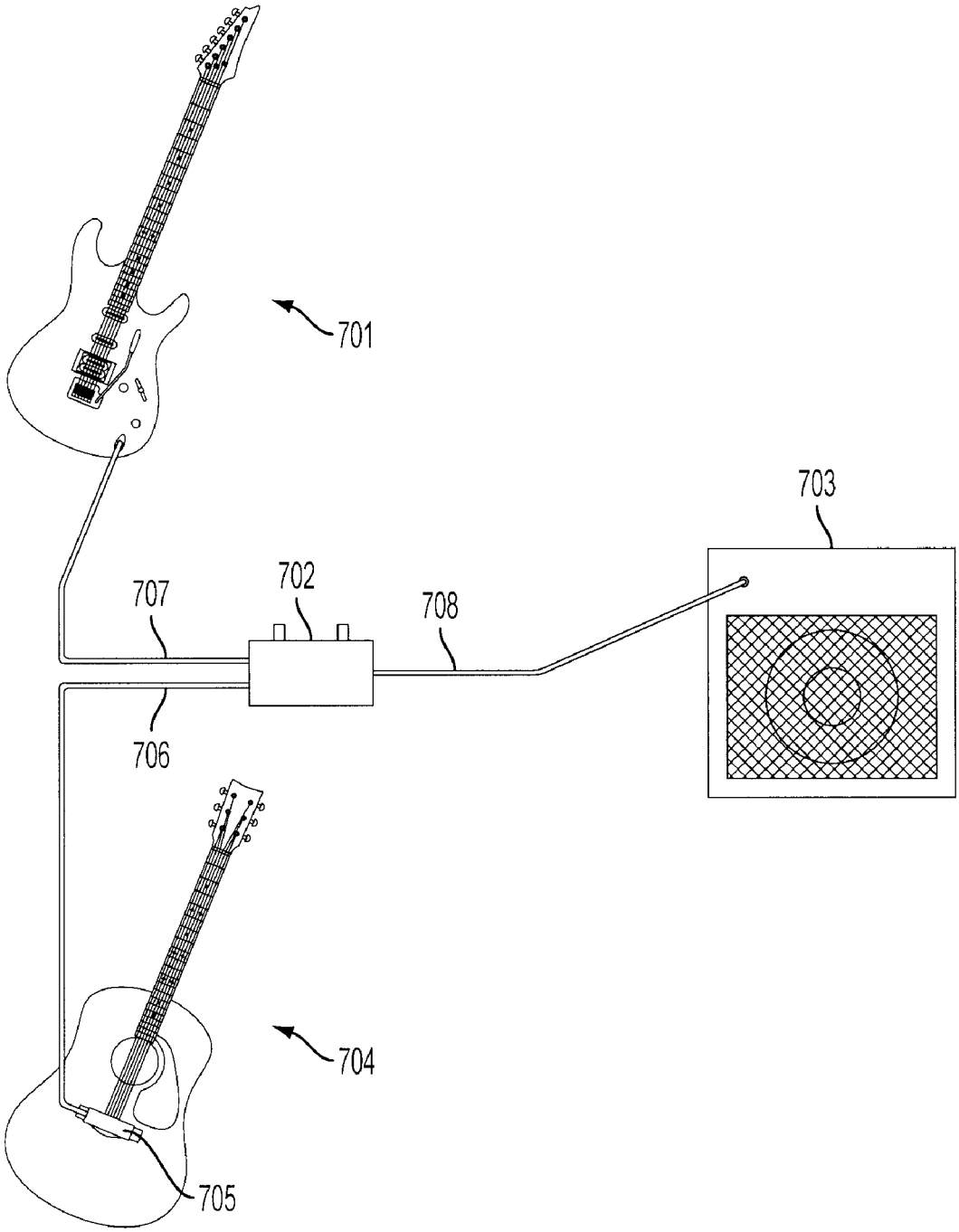
FIG. 7 illustrates the method of generating sound from an instrument by use of the disclosed system.

FIG. 7 depicts one configuration which uses the invented method to generate sound from a remote instrument. Electric guitar 701 creates an output signal when played by a musician. The signal is routed via cable 707 to an optional switching component 702 which provides selection of sending the signal to either musical instrument amplifier 703 via cable 708 or via cable 706 to the input of the disclosed system 705 which has been secured to acoustic guitar 704. When the signal is routed to musical instrument amplifier 703, the loudspeaker contained in musical instrument amplifier 703 converts the electrical signal to an audible acoustic signal and an electric guitar sound is heard. When the signal from the electric guitar 701 is routed to the input of disclosed system 705, the vibrations from the disclosed system 705 create vibrations in the acoustic guitar 704, which in turn create sound waves, and an acoustic guitar sound is heard.

The disclosed system may be adapted to instruments other than string instruments. For example, brass instruments may be made to work with the disclosed system using a coupling element adapted to attach at the mouthpiece of the instrument. Other instruments may be adapted by considering their primary mode of sound generation and constructing a coupling interface that uses the vibrations created by the exciter to generate vibrations in the instruments in a manner similar to their primary mode of sound generation. A reed instrument, for example, creates sound when air passing over a reed causes vibrations of the reed. By considering this primary mode of sound generation, one skilled in the art would understand that a coupling interface could be constructed to impart vibrations into the reed instrument in nearly the same location that the reed would normally be located. The vibrations from the disclosed system would then couple into the instrument in a manner substantially similar to the manner in which the vibrations from the reed couple into the instrument. This approach may used to determine the proper construction of the coupling interface for other instruments.

Some applications will benefit from the use of two or more exciters and the use of two or more coupling interfaces. This may be done to extend the frequency response of the system by having multiple exciters reproduce all or a subset of the frequencies from the overall desired frequency response. Multiple exciters or multiple coupling interfaces will also be useful to more accurately direct vibrations into certain parts of a musical instrument. An example would be a string instrument with multiple saddles having an exciter and coupling interface for each saddle. It would also be useful in some instruments to use one or more exciters and/or one or more coupling interfaces at the primary region of sound generation for the instrument combined with one or more exciters and/or one or more coupling interfaces in other locations on the instrument to reinforce the vibrations in the instrument, thereby providing a louder sound or an altered frequency response from the instrument.

It is also possible to use the disclosed system to excite an instrument in a manner different from its primary mode of sound generation. This may done to create new sounds from the instrument or to affect the spectral characteristics of the sound from an instrument. Additionally the disclosed system may even be fed an input signal generated by the instrument itself in the normal manner of playing the instrument to alter the sound or performance of the instrument. As an example, the primary mode of sound generation in a brass instrument is the vibration of the lips of the musician blowing into the mouthpiece. The disclosed system may be attached to another part of the instrument, for example the bell, to get a different sound from the instrument when presented with a signal from either an external source or from the same instrument. If the disclosed system is located at the bell of the instrument, for example, and the musician plays the instrument normally, the disclosed system would then impart different vibrations into the instrument than the normal ones. These two different sources of vibrations would combine within the instrument, creating spectral changes in the sound coming from the instrument thereby generating new sounds not available from the instrument without the use of the disclosed system. This same approach may be applied to other musical instruments.

Figure 8:
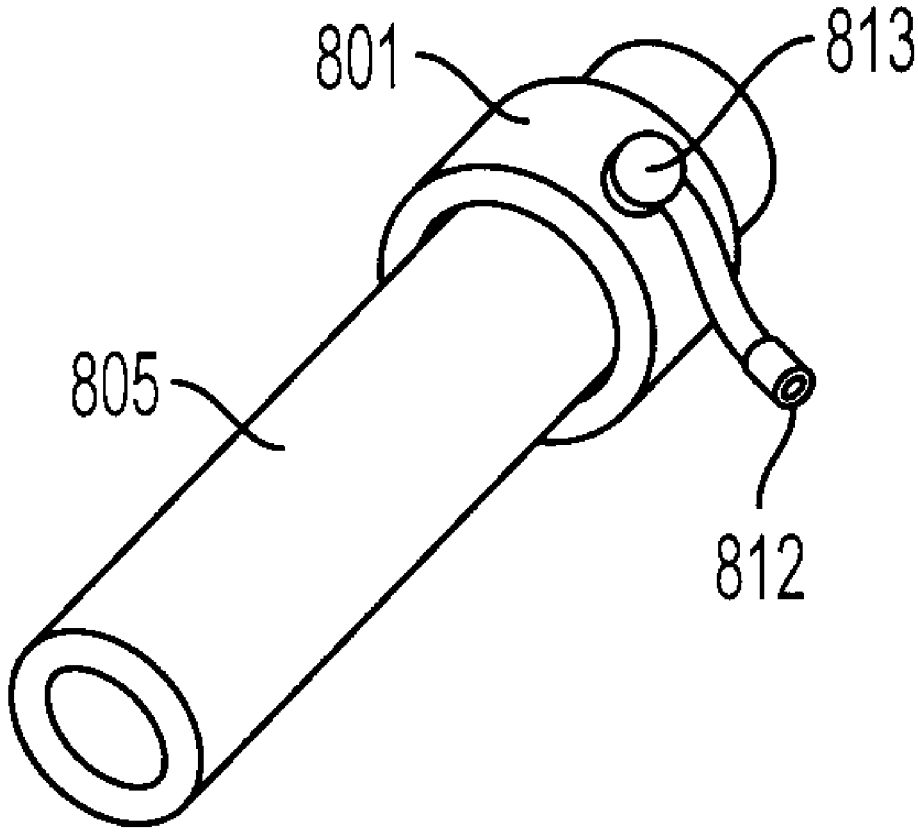
FIG. 8 illustrates the use of the disclosed system to generate sound from an object other than a musical instrument

The disclosed system may be constructed in such a manner to allow mounting to objects not normally considered to be music instruments such as boxes, pipes, etc. When using the disclosed system with these objects, the optimum point of coupling will vary depending on the object used and will need to be determined through experimentation to find the point that provides the desired sound. The object must have some acoustic properties, meaning it must be capable of producing an audible output from the vibrations imparted by the disclosed system. FIG. 8 shows how the disclosed system may be used to create a musical instrument from a length of pipe. Mounting adapter 801 is secured to pipe 805. Mounting adapter assembly 801 is constructed to provide good coupling between the vibrations of the exciter 813 and the outer wall of pipe 805. Input 812 is electrically connected to the exciter 813. A signal from a musical instrument (not shown) is applied to input 812, causing exciter 813 to create mechanical vibrations which are coupled by mounting assembly 801 into the pipe 805. The vibrations in pipe 805 cause vibrations of the air in and around the pipe 805, creating audible acoustic waves. The length of the pipe 805 and the location of the mounting adapter assembly 801 along the length of the pipe 805 will affect the spectral characteristics of the resulting acoustic waves, creating a sound different than that of the original input signal.

I claim:

1. A system comprising:

an input configured to receive an externally generated signal representative of sound produced by a first musical instrument;

an amplifier configured to increase the power of the signal;

a power supply capable of supplying power to the amplifier;

at least one exciter configured to accept the amplified signal as its input and to produce mechanical vibrations as its output;

at least one coupling interface operatively connected to the exciter and configured to accept the mechanical vibrations of the exciter and transfer the mechanical vibrations to an acoustic guitar, thereby creating vibrations in the acoustic guitar;

and wherein the input, the amplifier, and the exciter are housed in a single housing distinct from the acoustic guitar.

2. The system of claim 1 wherein the at least one coupling interface couples the vibrations to the acoustic guitar by imparting the vibrations into a saddle of the acoustic guitar, the vibrations then being transmitted to a body of the acoustic guitar through a bridge on the body of the acoustic guitar.

3. The system of claim 2 where the coupling of vibrations into the saddle does not require any strings to be present on the acoustic guitar to generate sound from the acoustic guitar.

4. The system of claim 1 wherein at least one of the at least one exciter and at least one of the at least one coupling interface are integrated into the acoustic guitar.

5. The system of claim 1 further comprising a mounting adapter to secure the system to the acoustic guitar.

6. The system of claim 5 wherein the mounting adapter is operatively connected to the exciter and serves as the coupling interface to couple the vibrations to a saddle of the acoustic guitar by direct mechanical contact of a portion of the mounting adapter to a portion of the saddle.

7. The system of claim 6 wherein the mounting adapter includes at least one adjustable element to increase the amount of mechanical contact between the mounting adapter and the saddle.

8. The system of claim 1 wherein the input is configured to directly receive an unprocessed output signal from an electric guitar.

9. The system of claim 8 further comprising a switching circuit and an output, wherein the switching circuit is configured to alternatively route the signal to the amplifier or to the output.

10. A system comprising:

an input configured to receive an externally generated signal representative of sound of a first musical instrument;

at least one exciter configured to accept the signal as its input and to produce mechanical vibrations as its output, independent of any other system elements;

at least one coupling interface operatively connected to the exciter to receive the mechanical vibrations and transfer the mechanical vibrations to a second musical instrument and thereby create vibrations in the second musical instrument;

and wherein the exciter is attached to an external element of the instrument.

11. The system of claim 10 where the sound produced by the second musical instrument is different than the sound produced by the first musical instrument.

12. The system of claim 10, wherein the system is adapted to interface with a string instrument.

13. The system of claim 12 where at least one of the at least one coupling interface(s) couples the mechanical vibrations directly to a bridge of the string instrument, which then transmits the vibrations into a body of the string instrument.

14. The system of claim 12 wherein at least one of the at least one coupling interface(s) couples the vibrations to a portion of the string instrument in a region immediately surrounding a bridge of the string instrument by direct contact of the at least one coupling interface to the string instrument in said region.

15. The system of claim 10, wherein at least one of the at least one exciter(s) is an electromagnetic actuator comprising at least a permanent magnet and a coil of wire, wherein a current passing through the coil of wire creates a magnetic field with alternating phase relative to the permanent magnet, causing the coil of wire to move and thereby create mechanical vibrations in the exciter.

16. The system of claim 10, wherein the signal applied to the input is delivered to the system by a wireless connection using light, audio, or radio frequency waves.

17. The system of claim 10 wherein at least one of the at least one exciter and at least one of the at least one coupling interface are integrated into the second musical instrument.

18. The system of claim 10 additionally comprising at least one amplifier and at least one power supply.

19. The system of claim 10 additionally comprising at least one signal conditioning element.

20. The system of claim 10 wherein the at least one exciter comprises at least a first exciter and a second exciter employed on the same second musical instrument.

21. The system of claim 20 wherein the range of mechanical vibrations produced by the first exciter is different than the range of mechanical vibrations produced by the second exciter.

22. The system of claim 21 further comprising a first coupling interface operatively connected to the first exciter and a second coupling interface operatively connected to the second exciter and wherein the first coupling interface and the second coupling interface contact the second musical instrument at different locations on the second musical instrument, the combination producing an altered frequency response of the second musical instrument.

23. A system comprising:

an input configured to receive a signal representative of the sound of a first musical instrument;

at least one exciter configured to convert the signal to a corresponding first set of mechanical vibrations;

a coupling interface operatively connected to and distinct from the exciter and configured to couple the first set of mechanical vibrations to a second musical instrument and thereby generate a corresponding second set of vibrations in the second musical instrument.

24. A method of generating sound from a musical instrument using a signal created externally from the instrument to excite vibrations in the instrument, the method comprising the steps of:

a. generating a signal representative of the sound of a first musical instrument;

b. transmitting the signal;

c. receiving the signal at an input;

d. converting the signal to mechanical vibrations using an exciter configured to accept the signal as its input and to produce a corresponding first set of mechanical vibrations as its output;

e. coupling the first set of mechanical vibrations to a second musical instrument using a coupling interface operatively connected to the exciter, wherein the coupling interface is configured to receive the first set of mechanical vibrations and to transfer the first set of mechanical vibrations to the second musical instrument, thereby producing a second set of mechanical vibrations in the second musical instrument.

25. The method of claim 24 wherein the first set of mechanical vibrations has a different frequency response than the second set of mechanical vibrations.

26. The method of claim 24 wherein converting the signal to mechanical vibrations employs an electromagnetic actuator comprising at least a permanent magnet and a coil of wire, wherein a current passing through the coil of wire creates a magnetic field with alternating phase relative to the permanent magnet, causing the coil of wire to move and produce mechanical vibrations in the exciter.

27. The method of claim 24 wherein the second musical instrument is a string musical instrument having at least a string resting on a bridge, and wherein the coupling interface transfers the first set of vibrations to the second musical instrument by direct mechanical contact of the coupling interface to a region of the bridge proximate to where the string rests on the bridge.

28. A transducer system for generating sound from a string instrument, the string instrument having a string resting on a bridge or having a string resting on a saddle secured by a bridge, wherein the transducer system comprises:

A) an input configured to receive a signal representative of sound of a first musical instrument;

B) a unified structure, including a housing, to which system elements are operatively connected;

C) an exciter configured to accept the signal as its input and produce mechanical vibrations as its output, the mechanical vibrations being transmitted into the structure;

D) a coupling interface operatively connected to the structure and configured to transfer the mechanical vibrations by mechanical contact of the coupling interface to the bridge or to the saddle, proximate to the resting point of the string, thereby transmitting vibrations through the bridge into the string instrument;

E) an integrated mounting adapter for attaching the transducer system to the string instrument.

29. System of claim 28 wherein the mounting adapter is integrated with the coupling interface and further comprises at least one adjustable element to increase mechanical contact between the coupling interface and the bridge or the saddle.

* * * * *